US005988285A

United States Patent [19]

Tucker et al.

[11] Patent Number: 5,988,285

[45] Date of Patent: Nov. 23, 1999

[54] ZONE ISOLATION SYSTEM

[75] Inventors: Andrew J. Tucker; Harold S. Bissonnette, both of Lafayette, La.

[73] Assignee: Schlumberger Technology Corporation, Sugar Land, Tex.

[21] Appl. No.: 08/918,213

[22] Filed: Aug. 25, 1997

[51] Int. Cl.[6] ..... E21B 34/14; E21B 43/12

[52] U.S. Cl. ..... 166/373; 166/386; 166/334.4

[58] Field of Search ..... 166/278, 373, 166/386, 334.1, 334.4

[56] References Cited

U.S. PATENT DOCUMENTS

| | | | |
|---|---|---|---|
| 4,401,158 | 8/1983 | Spencer et al. | 166/278 |
| 4,858,690 | 8/1989 | Rebardi et al. | 166/278 |
| 5,579,844 | 12/1996 | Rebardi et al. | 166/296 |
| 5,609,204 | 3/1997 | Rebardi et al. | 166/51 |

OTHER PUBLICATIONS

Schllumberger Oilfield Services Brochure, "PERFPAC Intergrated Perforating and Gravel Packing," Oct. 1995.

Schlumberger Dowell Technical Paper, "Sand Control: Why and How?" p. 41–53, Oct. 1992.

*Primary Examiner*—William Neuder

*Attorney, Agent, or Firm*—Douglas Y'Barbo

[57] ABSTRACT

A system for isolating a production pipeline string from the flow of fluids includes an isolation pipe string assembly. The isolation pipe string assembly is positioned by a shifting collet assembly so that in a first position fluids are allowed to the well bore through a sand control production screen. The shifting collet assembly is then used to position the isolation pipe string assembly in a second position wherein seals are placed both above and below the sand control production screen so that fluids are not allowed to re-enter the well bore.

17 Claims, 7 Drawing Sheets

ZONE ISOLATION SYSTEM

FIELD OF THE INVENTION

The present invention applies to tools used following the gravel pack method of well completion; more particularly, the present invention describes a system for the placement of an isolation pipe string assembly within a well bore to prevent the flow of completion fluids through a sand control production screen after gravel packing the well bore.

BACKGROUND

Once a well has been drilled into an underground formation to obtain fluids contained in the underground formation, it is necessary to establish a system for removal of these fluids from the formation through the well bore. Typically the fluids enter the passages or tunnels which are formed in the formation. As the passages or tunnels are positioned to be near perforations formed in the casing which lines the well bore, the fluids flow through these perforations into the production piping through a screen formed in the production piping. Following the completion of a well, the fluids flow out the top of the well through one or more openings formed in the wall of an isolation pipe string assembly.

Wells drilled in sandy formations present distinct problems for well operators. Not only does the sand from the formation clog equipment, its abrasive nature quickly damages the equipment used to conduct fluids out of the well bore. Further, when sand is removed from the formation from which fluids are obtained, the formation surrounding the well bore may actually collapse and thus prevent further extraction of fluids from the well.

The necessity for and the systems typically used to control sand in wells is explained in an article entitled "Sand Control: Why and How?" which was published in *Oil Field Review* 4, No. 4 (October 1992) at pages 41–53.

To assure the continuous production of fluids through the well bore it is necessary to stabilize the passages or tunnels formed in the sandy formation through which the fluids must pass before being extracted through the well bore. Such stabilization is called well completion. Several different methods are typically used to stabilize the passages or tunnels which emanate outwardly from the well bore. The most popular of these well completion methods is known as gravel packing.

In the gravel packing method of completion of a well, gravel and a carrier or completion fluid are injected into the well in the form of a slurry. The slurry is guided into position near that portion of the formation through which fluid flow using a gravel packer assembly. The solid portion of the gravel slurry collects in the tunnels formed in the sandy formation through which the fluids pass and it also collects in the annular space between the interior wall of the casing which lines the well bore and the exterior wall of the production piping which is passed through the casing. This collection of solid gravel both stabilizes the tunnels formed in the sandy formation exterior to the well bore and it also acts as a filter to dramatically reduce the amount of sand which flows into the production piping.

The carrier fluid, or the completion fluid, which is used to create the gravel slurry to move the solid gravel into the well bore and into the tunnels which emanate outwardly from the well bore either leaks off into the sandy formation or is allowed to flow back into the well. In many situations well operators desire to prevent the flow of completion fluids through the sand control production screen. Accordingly, there is a need for a downhole tool which will prevent undesired fluids from flowing through the sand control production screen.

A didatic description of a system for the placement of a gravel pack assembly in a well appears in U.S. Pat. No. 4,858,690. This patent describes the placement of a gravel pack or assembly in a sub-sea well.

U.S. Pat. Nos. 5,579,844 and 5,609,204 describe systems for the zonal isolation of wells from the flow of completion fluids. The construction of the tools described in these two patents is complex and accordingly these zonal isolation tools are expensive and difficult to operate.

Therefore a need remains in the art to provide an inexpensive zone isolation system for use with a gravel packer assembly which has a minimum number of parts and is both reliable and easy to operate.

SUMMARY

An inexpensive, reliable, easy to operate system for the zonal isolation of a production pipeline string from the flow of fluids through the sand control production screen utilizes the movement of a shifting collet within a housing to position an isolation pipe string assembly within the sand control production screen portion of production piping. In a first position of the isolation pipe string assembly, fluid is allowed to flow through the sand control production screen and move upwardly through the well bore through a wash pipe to the surface. In a second position, the flow of fluid through the sand control production screen is blocked by fluid seals located on the isolation pipe string assembly which sealingly engage surfaces both above and below the sand control production screen. Because a two stroke motion is required to move the zone isolation system of the present invention into the second position, an opportunity is provided for the well operator to make repairs to or adjust the service tool, the production pipe line or packing assemblies before the flow of fluid through the sand control production string is blocked.

BRIEF DESCRIPTION OF DRAWINGS

A further understanding of the zone isolation system of the present invention may be had by reference to the drawing figures wherein.

DESCRIPTION OF THE EMBODIMENTS

A still further understanding of the construction and operation of the zone isolation system 10 of the present invention may be had by reference to the following discussion of the preferred embodiment as illustrated in the accompanying drawing figures.

Figure 1A:
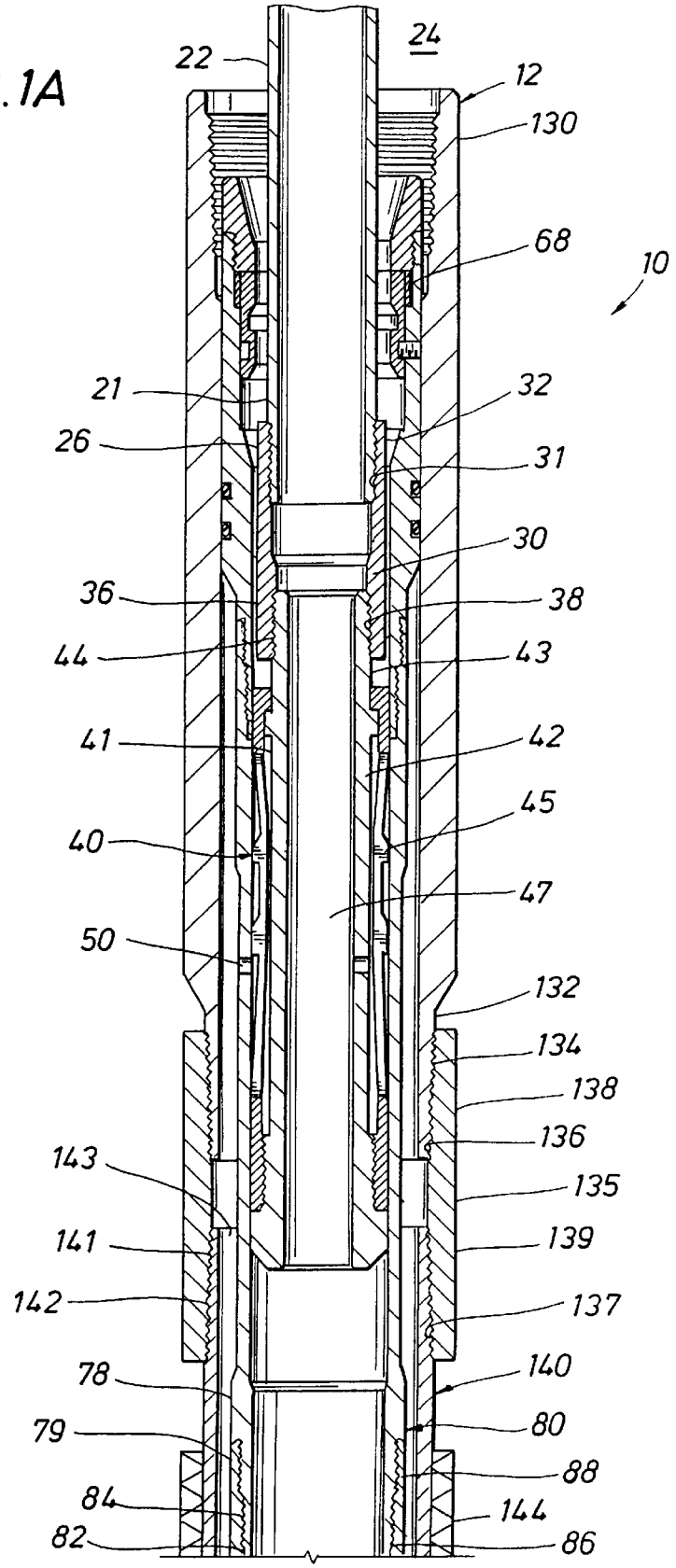
FIG. 1 is an elevational view in partial section of the zone isolation system of the present invention wherein fluid is allowed to pass into the well bore.
Figure 1B:
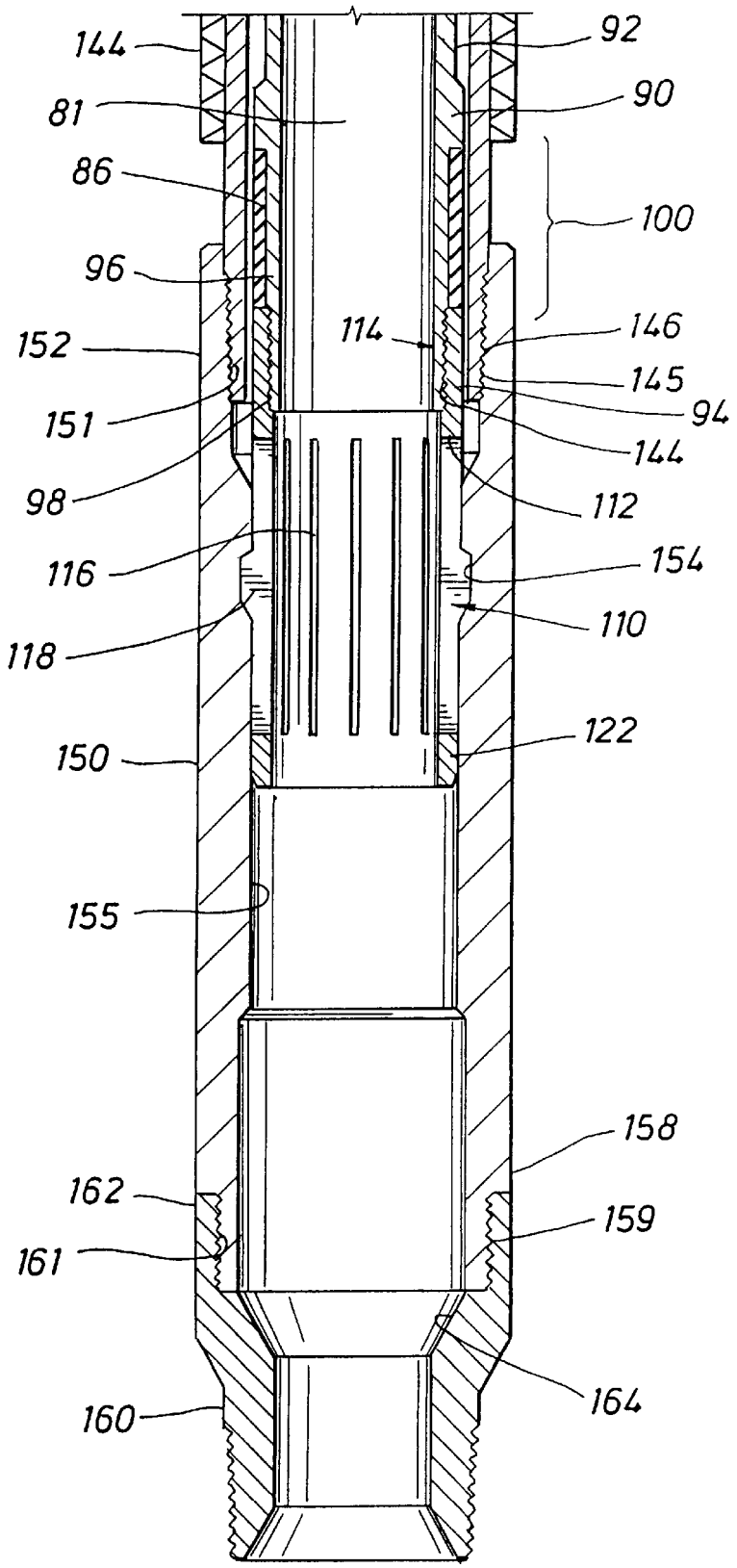

In FIG. 1, the zone isolation system 10 of the present invention is shown positioned within a production piping assembly 12. The production piping assembly 12 includes an upper polished bore receptacle or PBR 130 which is connected by external threads 134 at its distal end 132 to internal threads 136 in the proximal end 138 of a collar 135. The distal end 139 of the collar 135 is connected by internal threads 137 to external threads 141 located on the proximal end 142 of a blank pipe and screen assembly 140. The blank pipe and screen assembly 140 is in turn threadably connected by external threads 145 on its distal end 146 to internal threads 151 on the proximal end 152 on a lower PBR 150. The distal end 158 of the lower PBR 150 is connected by external threads 159 to internal threads 161 located on the proximal end 162 of a bottom sub 160.

At the proximal end of the production piping assembly 12 is located a washpipe 22, a top sub 30 and a shifting collet assembly 40. The distal end 21 of the wash pipe 22 is connected by external threads 26 to internal threads 31 located on the proximal end 32 of the top sub 30. The distal end 36 of the top sub 30 is connected by internal threads 38 to external threads 44 formed on the proximal end 43 of a mandrel 42. The mandrel 42 carries the shifting collet 45 on its exterior surface 41. If desired, holes or slots 50 (shown only in FIG. 1) may be formed through the mandrel 42 to prevent the buildup of sand in the space between the bottom of the flexible beam portions 51 (FIG. 2) and the exterior surface 41 of the mandrel 42.

Figure 2:
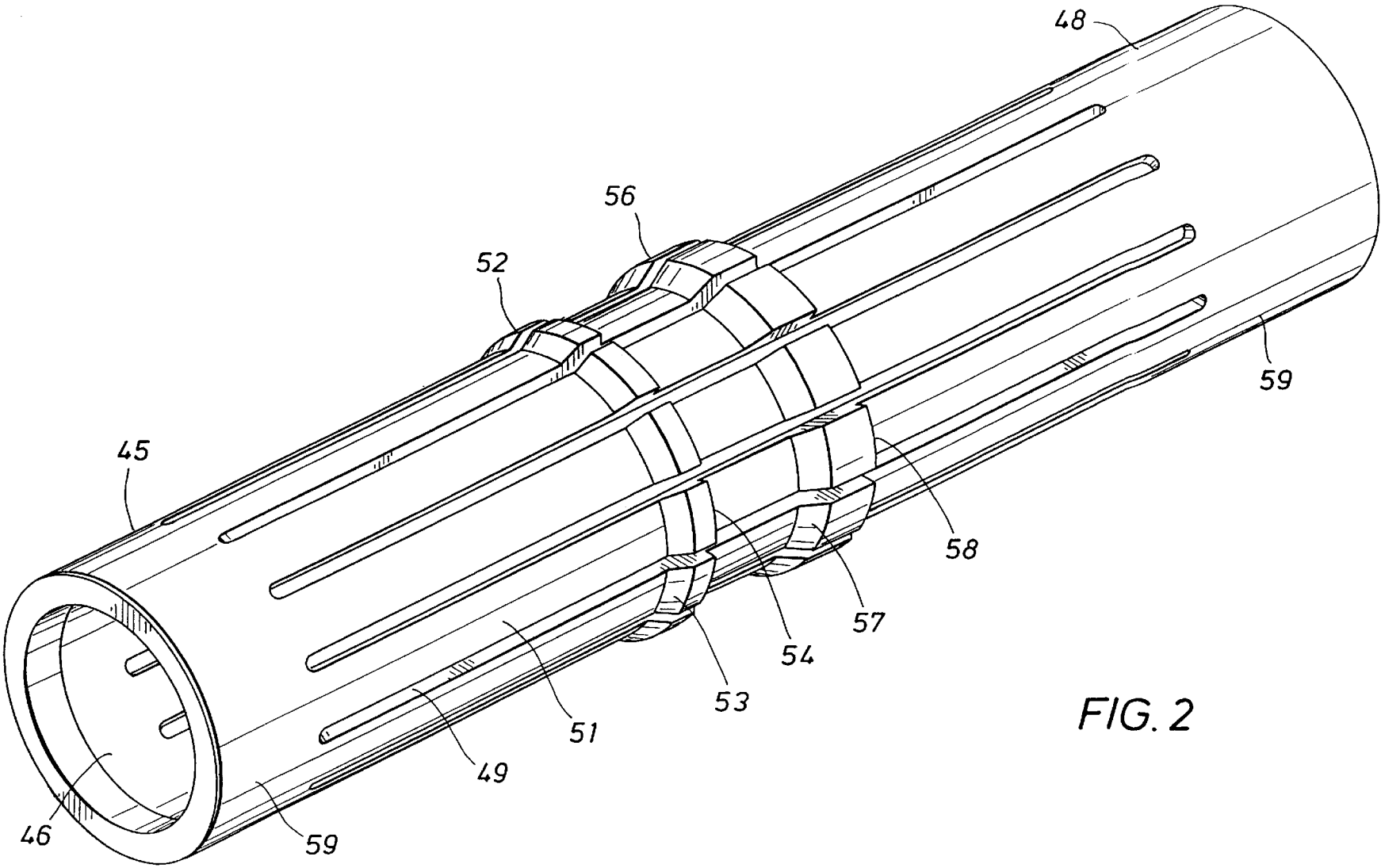
FIG. 2 is a perspective view of the shifting collet.

The shifting collet 45 itself is shown in FIG. 2. It includes an interior bore 46 for housing the mandrel 42. Formed on the exterior surface 48 are a plurality of proximal projections 52 and a plurality of distal projections 56. The proximal projections 52 includes a ramp 53 and a shoulder 54. Similarly, the distal projections 56 include a ramp 57 and a shoulder 58. Slots 49 are formed in the shifting collet 45 so that the projections 52 and 56 are effectively located on a flexible beam 51 anchored at the solid portions 59 either end of the shifting collet 45. The utilization of the flexible beam 51 portion of the shifting collet 45 will be explained below.

Figure 3:
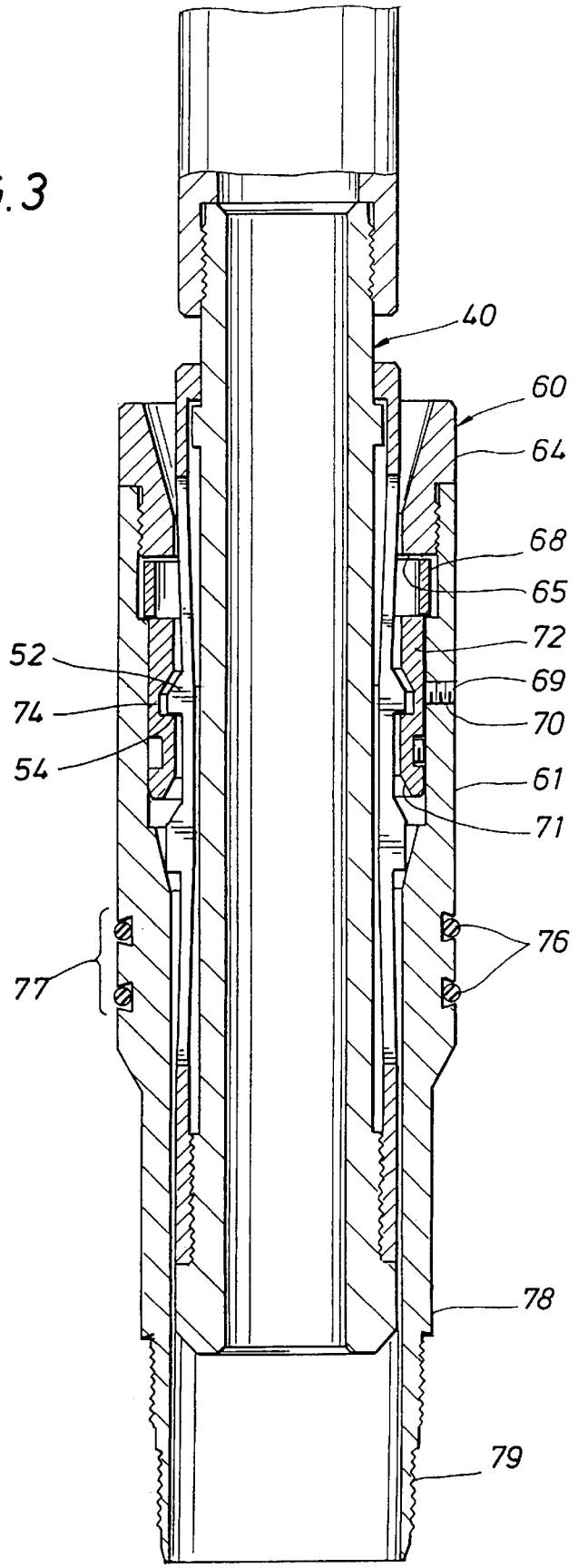
FIG. 3 is an elevational view in partial section of the initial movement of the shifting collet assembly through the shifting collet housing assembly.
Figure 4:
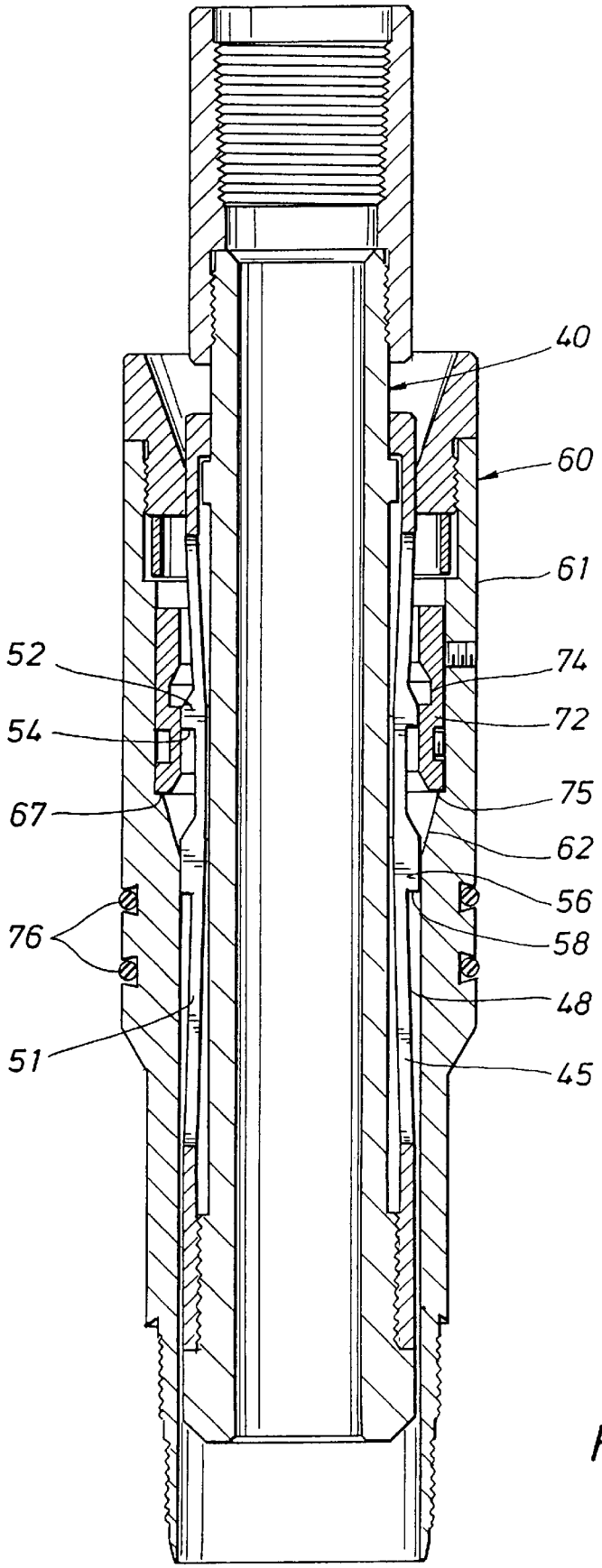
FIG. 4 is an elevational view in partial section of the further movement of the shifting collet assembly through the shifting collet housing assembly.

As shown by reference to FIG. 3 and to FIG. 4, the shifting collet assembly 40 is sized to fit within a shifting collet housing assembly 60. Located on the exterior 61 of the shifting collet housing assembly 60 are a pair of O-rings 76 which form a proximal fluid seal assembly 77 against the interior 131 (FIG. 5) of the upper PBR 130. Alternatively, bonded seals as explained below in the description of the lower collet assembly 110 may be used.

By reference back to FIG. 1, it may be seen that the distal end 78 of the shifting collet housing assembly 60 is threadably connected to the internal threads 84 formed on the proximal end 82 of the isolation pipe string assembly 80. The external threads 88 on the distal end 86 of the isolation pipe string assembly 80 are threadably connected to the internal threads 94 formed on the proximal end 92 of a seal sub 90. Surrounding the seal sub 90 at its distal end 96 is a distal seal 100 which forms a fluid seal against the interior surface 155 of the lower PBR 150.

Connected to the external threads 98 formed on the distal end 96 of the seal sub 90 are the internal threads 114 formed on the proximal end 112 of a lower collet assembly 110. The lower collet assembly 110 includes slots 116 through which fluids passing through the sand control production screen 144 may flow.

By further reference to FIG. 1, the flow path for fluids will be through sand control production screen 144, thence through the annulus 143 between the blank pipe and production screen assembly 140 and the ioslation pipe string assembly 80, past the distal seal 100 and through the slots 116 in the lower collet assembly 110 and then upward through the interior bore 81 of the isolation pipe string assembly 80, through the interior bore 47 of the mandrel 42, through the top sub 30 and finally through the wash pipe 22. Travel of fluid through the annulus 143 between the isolation pipe string assembly 80 and the blank pipe and screen assembly 140 is prevented by the proximal fluid seal 77 (FIG. 3) between the shifting collet housing assembly 60 and the upper PBR 130.

When it is desired to prevent the flow of fluid through the interior 81 of the isolation pipe string assembly 80 it is necessary to move the isolation pipe string assembly 80 into a lower or more distal position within the well bore 24. As may be seen in FIG. 5, this lower or more distal position maintains the barrier to fluid flow formed by the proximal fluid seal 77 between the shifting collet housing assembly 60 and the inner bore 131 of the upper PBR 130. The distal seal 100 established by sealing contact between the seal assembly 100 and the inner bore 155 of the lower PBR 150 prevents fluid flow through the lower collet assembly 110. This distal seal 100 is established by a pair of bonded seals 101 and 102 including O-ring seals 103 and 104 on their interior surfaces. To recap, and as shown in FIG. 5, as fluid passes through screen 144 it is blocked from traveling upward through the well bore 24 by the proximal fluid seal assembly 77 formed against the interior bore 131 of the upper PBR 130 and it is blocked from traveling through the slots 116 in the lower collet assembly 110 by the distal fluid seal assembly 100 formed against the interior wall 155 of the lower PBR 150.

Figure 5A:
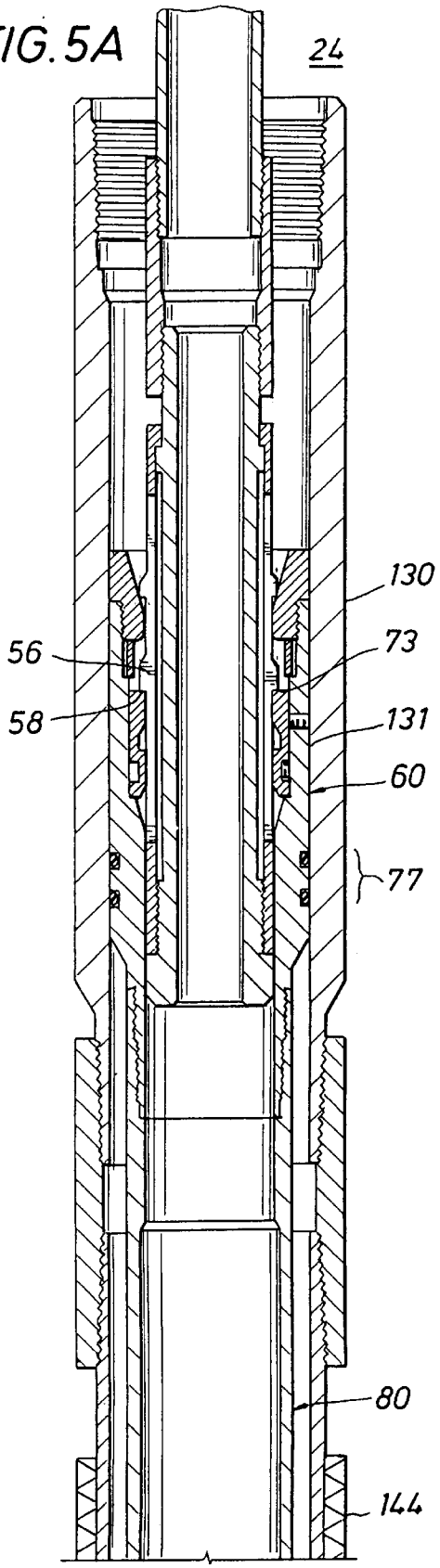
FIG. 5 is an elevational view in partial section of the zone isolation system in a second position wherein the flow fluid through the sand control production screen is prevented from flowing back the well bore.
Figure 5B:
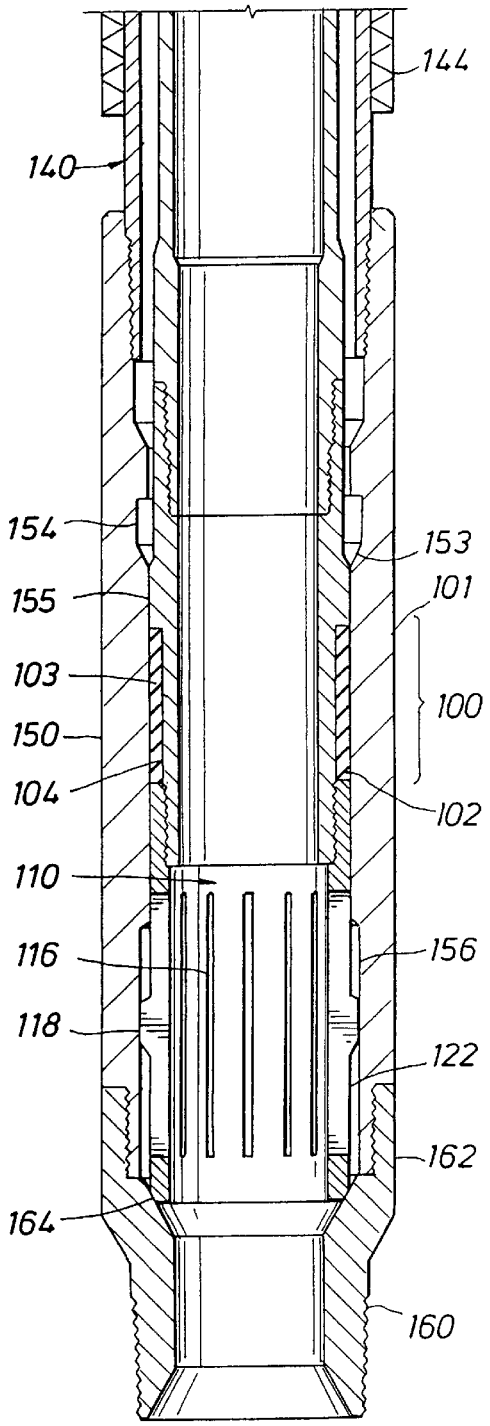

The movement of the isolation pipe string assembly 80 to its second or more distal position within the well bore 24 is a two stroke operation as shown in FIGS. 3, 4 and 5. First, the shifting collet assembly 40 is pulled upwardly through the isolation pipe string assembly 80 and through the shifting collet housing assembly 60. Such withdrawal of the shifting collet assembly 40 through the shifting collet housing assembly 60 causes the ramps 53 and 57 on the proximal and distal projections 56 emanating from the side 48 of the shifting collet 45 (FIG. 2) to slide past the ramp 71 formed on the bottom of the sliding release sleeve 72 and past the ramp 65 formed on the bottom of the entry guide 64.

Once the shifting collet assembly 40 has been pulled through the shifting collet housing assembly 60, it is reinserted into the shifting collet housing assembly as shown in FIG. 3. It is at this time that any repairs or adjustments to the service tool, the production pipeline or any of the packing assemblies may be made. This reinsertion of the shifting collet assembly 40 into the shifting collet housing assembly 60 causes the proximal projections 52 on the exterior surface 48 of the shifting collet 45 to enter the recess 74 in the center portion of the sliding release sleeve 72. The shoulders 54 on the bottom of the proximal projections 52 push against the bottom of the recess 74 and severs the shear screw 69 which, by threadable engagement with hole 70 has held the sliding release sleeve 72 in a proximal position with respect to the shifting collet housing assembly 60 as shown in FIG. 1.

The movement of the sliding release sleeve 72 after the shear screw 69 has been severed, as shown in FIG. 3, accomplishes two things. First, the snap ring 68 collapses inward as it no longer is held in its distended position by the proximal location of the sliding release sleeve 72 (FIG. 1).

The collapsed position of the snap ring 68 prevents upward movement of the sliding release sleeve 72 back through the shifting collet housing assembly 60. Second, as shown in FIG. 4, the bottom shoulder 75 of the sliding release sleeve 72 engages a shoulder 67 formed within the shifting collet housing assembly 60. The shifting collet 45 continues to pass through the shifting collet housing assembly 60. The shoulders 58 on the distal projections 56 of the exterior surface 48 of the shifting collet 45 ride down ramp 62. This movement causes a downward movement of the flex beam 51 portion of the shifting collet 45 which draws the proximal projections 52 out of the recess 74 formed in the sliding release sleeve 72. Further travel of the shifting collet assembly 40 through the shifting collet housing assembly 60 will cause the shoulders 54 on the proximal projections 56 to move along ramp 62.

Once the shifting collet assembly 40 has passed through the shifting collet housing assembly 60 a first time, the shifting collet assembly 40 is withdrawn back through the shifting collet housing assembly 60. The shifting collet assembly 40 is now caused to enter the shifting collet housing assembly 60 a second time. This re-entry of the shifting collet assembly 40 into the shifting collet housing assembly 60 is shown in FIG. 5. The shoulder 58 on the bottom of the distal projection 56 engages the shoulder 73 on top of the sliding release sleeve 72. Continued downward force by the shoulder 58 on the distal projection 56 against the shoulder 73 on top of the sliding release sleeve 72 will cause the entire isolation pipe string assembly 80 to move to the distal end of the well bore 24.

As may be seen by comparing FIG. 1 to FIG. 5, the downward movement of the isolation pipe string assembly 80 within the well bore 24 can only be accomplished if the projection 118 on the exterior of the lower collet assembly 110 is moved out of engagement with proximal recess 154 formed within lower PBR 150. Such movement will allow the distal seal assembly 100 to move from within the blank pipe and screen assembly 140 to a position wherein sealing contact is formed against the interior wall 155 of the lower PBR 150. Once the isolation pipe string assembly 80 is moved by the force of shoulder 58 against shoulder 73 the projection 118 will move inward to slide along the interior 155 of the lower PBR 150 and then move outward to enter the distal recess 156 formed on the distal end 158 of the lower PBR 150. The distal end 122 of the lower collet assembly 110 will come to rest against a slant shoulder 164 formed within the bore of the proximal end 162 of the bottom sub 160.

Figure 6A:
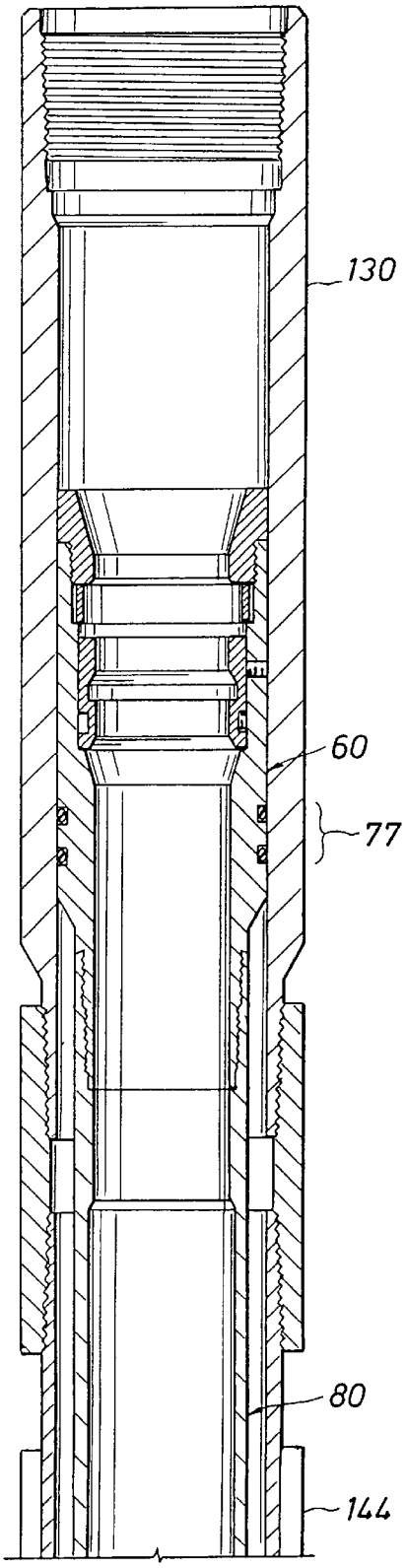
FIG. 6 is an elevational view in partial section of the zone isolation system with the shifting collet assembly removed therefrom.
Figure 6B:
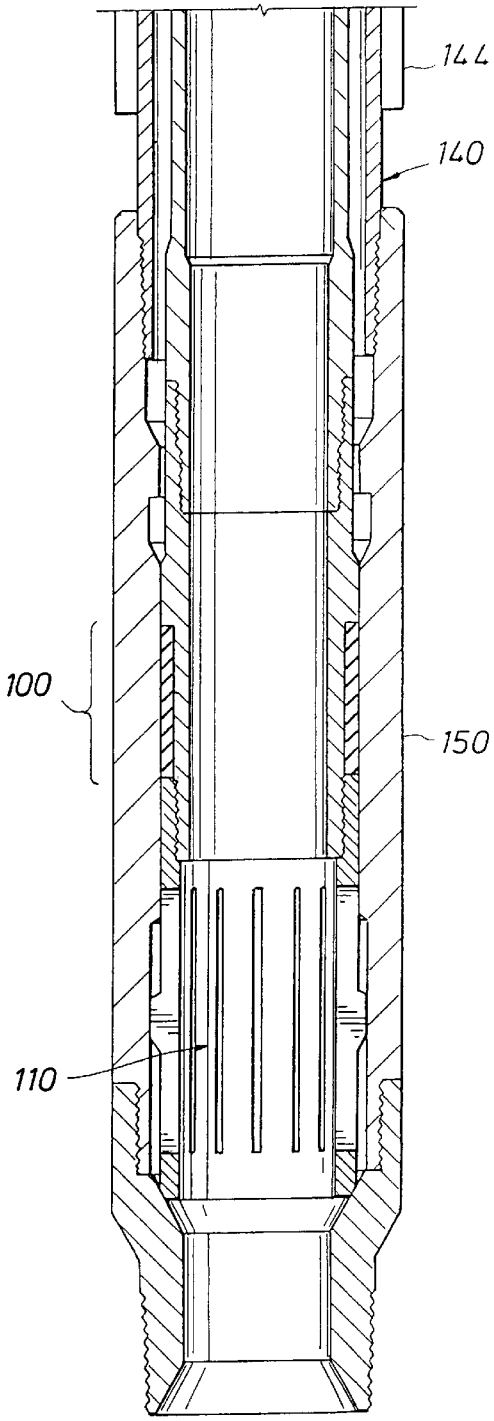

By reference to FIG. 6 there is nothing to retain the shifting collet assembly 40 within the shifting collet housing assembly 60, thus it may be easily removed as previously described. Passage of fluids from the formation surrounding the well bore 24 is accomplished by perforating the isolation pipe string assembly 80 or alternatively moving a sliding sleeve (not shown) which covers an opening formed in the isolation pipe string assembly 80.

Assembly of the System

The zone isolation system 10 of the present invention is assembled by threadably connecting the lower PBR 150 to the blank pipe and screen assembly 140. Next, the lower collet assembly 110 is threadably connected to the seal sub 90 which includes the distal seal assembly 100.

Next the lower collet assembly 110 is inserted into the lower PBR 150 so that the projection 118 on the exterior of the lower collet assembly 110 engages the proximal recess 154 after sliding along the entry ramp 153 (FIG. 5) formed on the proximal end 152 of the lower PBR 150. The shifting collet assembly 40 is then slid through the shifting collet housing assembly 60 so that the proximal projections 52 and the distal projections 56 on the exterior 48 of the shifting collet assembly 40 enters the interior bore 81 of the isolation pipe string assembly 80. The shifting collet housing assembly 60 is then attached to the top of the isolation pipe assembly 80. The wash pipe 22 is then thredably attached to the top sub 30. Finally, the upper PBR 130 is threadably attached to the blank pipe end screen assembly 140.

Operation

When it is desired to activate the zone isolation system 10 of the present invention to move the isolation pipe string assembly 80 further into the well bore 24 a service tool (not shown) is connected to the wash pipe 22 to pull the shifting collet assembly 40 out of the shifting collet housing assembly 60 so that the bottom of the shifting collet assembly 40 clears the top of the shifting collet housing assembly 60.

The next step is to apply a set-down weight on the shifting collet assembly 40. Because the distal projection 56 on the exterior of the shifting collet 45 is larger than the proximal projection 52, it slides past the recess 74 in the sliding release sleeve 72. When the proximal projections 52, which are sized to enter the recess 74 in the sliding release sleeve, the beam 51 flexes outward. This outward flexing of the beam 51 causes the shoulders 54 on the proximal projections 52 on the shifting collet assembly 45 to engage the bottom of the recess 74 in the sliding release sleeve 72. As previously indicated this causes the shear screw 69 to sever and the sliding release sleeve 72 to move downward into contact with a shoulder 67 within the shifting collet housing assembly 60. The snap ring 68 is now free to move inward to block the upward travel of the shifting release sleeve 72. The inward flexing of the beam portions 51 of the shifting collet 45 cause the proximal projections 52 to move out of the recess 73. This completes the first entry of the shifting collet assembly 40 into the shifting collet housing assembly 60.

The closing off the sand control production screen 144 from the flow of fluid is accomplished by moving the distal seal 100 into contact with the interior surface 155 of the lower PBR 150. This movement is accomplished by a second insertion of the shifting collet assembly 40 into the shifting collet housing assembly 60. The shoulders 58 on the distal projections 56 engage the top of the sliding release sleeve 72 which causes the bottom of the sliding release sleeve 72 to push against a shoulder 67 formed within the shifting collet housing assembly 60. The area of surface engagement is sufficient to apply enough force on the shifting collet housing assembly 60 to move the projections 118 on the lower collet assembly 110 inward so that they may travel along the inner bore 155 of the lower PBR 150 before moving outward into recess 156. Because there are no threadable connections between the shifting collet assembly 40 and the shifting collet housing assembly 60, the shifting collet assembly 40 may be easily withdrawn back through the shifting collet housing assembly 60. The isolation pipe string assembly 80 is now in place behind the sand control production screen 144 with the proximal seal 77 blocking the upward passage of fluid and the distal seal 100 blocking the downward passage of fluid.

As the zone isolation system 10 of the present invention has now been explained by reference to its preferred embodiment, it will be understood by those of ordinary skill in the art that other embodiments incorporating the same principles of construction and operation as found in the instant invention may be fabricated by those of ordinary skill in the art. Such other embodiments shall be included within the scope and meaning of the appended claims.

We claim:

1. A zone isolation system for use with a production pipe assembly, said zone isolation system comprising:

a substantially cylindrical sand control production screen;

an isolation pipe string assembly constructed and arranged to be movable within said substantially cylindrical sand control production screen;

said isolation pipe string assembly including:

a proximal fluid seal;

a distal fluid seal;

a lower slotted section below said distal fluid seal;

a shifting collet assembly constructed and arranged to be movable within said isolation string assembly;

whereby in a first proximal position of said isolation pipe string assembly with respect to the production pipe assembly, said proximal fluid seal is in contact with the interior of said isloation pipe string assembly, said distal fluid seal is out of contact with the interior of said isolation pipe string assembly, and fluid may travel through said lower slotted section into the interior of said isolation pipe string assembly; and whereby said shifting collet assembly is constructed and arranged to interact with the interior of said isolation pipe string assembly to move said isolation pipe string assembly into a second distal position with respect to the production pipe assembly in which said proximal fluid seal is in contact with the interior of said isolation pipe string assembly and said distal fluid seal is in contact with the interior of said isolation pipe string assembly and fluid is prevented from traveling through said lower slotted section.

2. The zone isolation system as described in claim 1 wherein said isolation pipe string assembly includes a shifting collet housing assembly.

3. The zone isolation system as described in claim 2 wherein said shifting collet housing assembly further includes a sliding release sleeve.

4. The zone isolation system as described in claim 3 wherein said shifting collet assembly includes a projection constructed and arranged to engage and move said sliding release sleeve.

5. The zone isolation system as described in claim 4 wherein said shifting collet housing assembly includes a shoulder engageable by said sliding release sleeve.

6. The zone isolation tool as described in claim 1 wherein said shifting collet housing assembly includes a shifting collet and a mandrel constructed and arranged to pass through said shifting collet housing assembly.

7. The zone isolation tool as described in claim 6 wherein said shifting collet further includes a plurality of flex beam portions anchored to its ends.

8. The zone isolation tool as described in claim 6 wherein the wall of the mandrel includes holes formed therethrough.

9. A method for isolating a production pipe assembly in a well bore from re-entry of fluids through a sand control production screen comprising the steps of:

(a) attaching a shifting collet housing assembly to an isolation pipe string assembly;

(b) inserting said shifting collet housing assembly in said isolation pipe string assembly into the production pipe assembly;

(c) inserting a shifting collet assembly so that said shifting collet assembly engages the interior of said shifting collet housing assembly;

(d) imparting a downward force on said shifting collet assembly to move said isolation pipe string assembly into a position wherein said isolation pipe string assembly is in sealing contact with the production pipe assembly both above and below said sand control production screen.

10. The method as defined in claim 9 wherein said step (c) further includes moving a sliding release sleeve toward the distal end of said shifting collet housing assembly.

11. The method as defined in claim 10 further including the step of retaining said sliding release sleeve in place following its movement to the distal end of said shifting collet housing assembly.

12. The method as defined in claim 10 wherein the retention of said sliding release sleeve in place is accomplished by the collapsing of a snap ring.

13. The method as defined in claim 12 wherein said downward force on said shifting collet assembly is transferred to said sliding release sleeve within said shifting collet housing assembly.

14. The method as defined in claim 9 wherein said shifting collet assembly is drawn back through said shifting collet housing assembly prior to the commencement of step (d).

15. The method as defined in claim 14 wherein said downforce on said sliding release sleeve is transferred to said shifting collet housing assembly which causes the movement of said isolation pipe string assembly.

16. An isolated production pipe assembly formed according to a method comprising the steps of (a) providing a non-isolated production pipe assembly in a well bore, said non-isolated production pipe having a sand control production screen;

(b) attaching a shifting collet housing assembly to an isolation pipe string assembly;

(c) inserting said shifting collet housing assembly in said isolation pipe string assembly into said non-isolated production pipe assembly;

(d) inserting a shifting collet assembly so that said shifting collet assembly engages the interior of said shifting collet housing assembly; and (e) imparting a downward force on said shifting collet assembly to move said isolation pipe string assembly into a position wherein said isolation pipe string assembly is in sealing contact with the non-isolated production pipe assembly both above and below said sand control production screen, thereby converting said non-isolated production pipe assembly into said isolated production pipe assembly, wherein said isolated production pipe assembly in the well bore is isolated from re-entry of fluids through said sand control production screen.

17. An isolated production pipe assembly formed according to a method comprising the steps of (a) providing a non-isolated production pipe assembly in a well bore, said non-isolated production pipe having a sand control production screen;

(b) attaching a shifting collet housing assembly to an isolation pipe string assembly;

(c) inserting said shifting collet housing assembly in said isolation pipe string assembly into said non-isolated production pipe assembly;

(d) inserting a shifting collet assembly so that said shifting collet assembly engages the interior of said shifting collet housing assembly;

(e) drawing said shifting collet assembly back through said shifting collet housing assembly prior to the commencement of step (f); and (f) imparting a downward force on said shifting collet assembly to move said isolation pipe string assembly into a position wherein said isolation pipe string assembly is in sealing contact with the non-isolated production pipe assembly both above and below said sand control production screen, wherein said downward force on said sliding release sleeve is transferred to said shifting collet housing assembly which causes the movement of said isolation pipe string assembly, thereby converting said non-isolated production pipe assembly into said isolated production pipe assembly, wherein said isolated production pipe assembly in the well bore is isolated from re-entry of fluids through said sand control production screen.

* * * * *